US009950551B2

(12) United States Patent
Mueller

(10) Patent No.: US 9,950,551 B2
(45) Date of Patent: Apr. 24, 2018

(54) PREHEATING STATION FOR A SHAPING TOOL FOR SHAPING BOOK COVERS

(71) Applicant: Mueller Martini Holding AG, Hergiswil (CH)

(72) Inventor: Hans Mueller, Lauda-Koenigshofen (DE)

(73) Assignee: MUELLER MARTINI HOLDING AG, Hergiswil (CH)

( * ) Notice: Subject to any disclaimer, the term of this patent is extended or adjusted under 35 U.S.C. 154(b) by 0 days.

(21) Appl. No.: 15/492,025

(22) Filed: Apr. 20, 2017

(65) Prior Publication Data

US 2017/0305182 A1 Oct. 26, 2017

(30) Foreign Application Priority Data

Apr. 21, 2016 (CH) ..... 0533/16

(51) Int. Cl.
*B42C 11/04* (2006.01)
*B42C 7/00* (2006.01)

(52) U.S. Cl.
CPC ..... *B42C 7/004* (2013.01); *B42C 7/005* (2013.01); *B42C 11/04* (2013.01)

(58) Field of Classification Search
CPC ..... B42C 11/04; B42C 7/00
USPC ..... 412/19–25
See application file for complete search history.

(56) References Cited

U.S. PATENT DOCUMENTS

| | | | | |
|---|---|---|---|---|
| 5,868,539 | A * | 2/1999 | Rathert | B42C 11/04 281/21.1 |
| 6,460,843 | B1 * | 10/2002 | Dim | B42C 11/04 270/58.07 |
| 7,407,355 | B2 * | 8/2008 | Schmidkonz | B42C 11/045 412/19 |
| 7,918,775 | B2 * | 4/2011 | Pohlmann | B31F 1/0012 493/396 |
| 8,550,760 | B2 * | 10/2013 | Schilling | B42C 7/005 412/17 |
| 2003/0215308 | A1 | 11/2003 | Rather | |
| 2011/0123298 | A1 | 5/2011 | Mueller | |
| 2015/0251476 | A1 * | 9/2015 | Sakata | B42C 7/005 412/19 |
| 2015/0273926 | A1 | 10/2015 | Meineke et al. | |

FOREIGN PATENT DOCUMENTS

| | | | |
|---|---|---|---|
| DE | 19853254 | A1 | 5/2000 |
| EP | 1350634 | A2 | 10/2003 |
| EP | 2325020 | A1 | 5/2011 |
| EP | 2923852 | A2 | 9/2015 |

* cited by examiner

*Primary Examiner* — Shin H Kim
(74) *Attorney, Agent, or Firm* — Leydig, Voit & Mayer, Ltd.

(57) ABSTRACT

A preheating station for different shaping tools for shaping a folding region of a lying outstretched book cover includes a plurality of receiving spaces for the different shaping tools for shaping different book covers lying outstretched. At least one heating element is arranged in a region of each of the receiving spaces and a temperature sensor is connected to the heating element. A control device is connected to the one heating element and the temperature sensor. A sensor is connected to the control device and configured to detect at least one identifying feature of the different shaping tools received in the preheating station.

15 Claims, 7 Drawing Sheets

PREHEATING STATION FOR A SHAPING TOOL FOR SHAPING BOOK COVERS

CROSS-REFERENCE TO PRIOR APPLICATION

Priority is claimed to Swiss Patent Application No. CH 00533/16, filed on Apr. 21, 2016, the entire disclosure of which is hereby incorporated by reference herein.

FIELD

The invention relates to a preheating station for a shaping tool for shaping a folding region of a lying outstretched book cover, the folding region being adjacent on either side of a spine region, or for shaping the spine region and the folding region, corresponding to the shape of the spine of a book block in each case which subsequently forms a book together with one of the book covers, having a receiving space for the shaping tool having at least one heating element arranged in the region of the receiving space and at least one temperature sensor connected to said heating element. The invention also relates to shaping tools suitable for being preheated in such a preheating station and to a device having such a preheating station and a having plurality of different shaping tools.

BACKGROUND

The industrial finishing of hardcover books is predominantly carried out on book production lines on which book blocks are each combined with an associated book cover to produce finished books. During "casing-in", i.e. when the book cover is bonded to the book block, the exact joining of their edges is crucial for a harmonious binding. Therefore, the prior adjustment and if necessary, shaping, of the central region of the book cover, i.e. the spine region, which receives the spine of the book block in the finished book, is of importance for a high quality of book. Of similar importance is the shaping of the folded regions of the book cover which directly adjoin the central region on either side and later constitute the opening hinges of the finished book. The requirements for the shaping of the book cover, which is carried out under the effect of heat in each case, and therefore for the shaping tool used for this purpose, differ according to whether the finished book has a rounded or angular spine and according to the form of the rounding and according to the thickness of the book.

A device for rounding book covers, which have an insert in the spine region, in a book casing-in machine is known from DE19853254 A1. In this device, the spine region of the book cover is pressed against an elastically deformable supporting surface by means of a heated shaping tool. In this case, the spine region is rounded and the pressed-in folding regions are made flexible. Normally, the shaping tools are kept ready in conventional shape-dependent tiers and when the spine shape of the book cover or the thickness category of the associated book block changes they are swapped over. The newly inserted shaping tools, however, are not yet at an operating temperature and must therefore first be heated up after being installed.

EP1350634 A2 discloses a shaping tool for producing books having rounded spines, which comprises a rectangular frame having a plurality of adjacent lamellae that are adjustable relative to the height of the frame and also can be heated via the lateral parts of the frame. The lamellae can, however, only be heated with considerable sluggishness due to their mobility and the necessary height.

An apparatus for shaping book covers for books having straight spines is known from EP2325020 A1. The shaping tool of said apparatus, which are interchangeable depending on the thickness category of the books to be produced in each case, has two shaping rails which stand vertically, are spaced apart from one another, and each rest on a tool beam by means of a base rail. In order to form the spine region of the book cover and the folding regions provided on either side of the spine region, the shaping rails are raised together with their tool beam from a lowered position at a distance from the book cover to be shaped, which is initially still in an outstretched state, against counter shaping rails arranged thereabove. To shape the book cover, heat is applied via the shaping tool. For this purpose, the tool beam carrying the shaping tool rests on an intermediate element, which is designed as a heating element and is equipped with heating rods. The shaping tool is both brought up to an operating temperature and kept at this temperature by the heating element.

In addition to a first shaping tool for book covers of books having straight spines, EP2923852 A2 also discloses a second shaping tool for book covers for books having round spines. Using the second shaping tool, the spine region of a book cover can be rounded while it is being raised from its outstretched position, it being possible to produce different formats and contours of the spine region. Because the shaping tools are equipped with identical interfaces, they can, if required, i.e. in the case of a change of order from shaping of book covers for books having straight spines to shaping of book covers for books having rounded spines, be interchanged. In this case, however, shaping of the book cover using heat application via the relevant shaping tool is not disclosed.

SUMMARY

In an embodiment, the present invention provides a preheating station for different shaping tools for shaping a folding region of a lying outstretched book cover on either side of a spine region or for shaping the spine region and the folding region. A plurality of receiving spaces for the different shaping tools for shaping different book covers lying outstretched are provided. At least one heating element is arranged in a region of each of the receiving spaces and at least one temperature sensor is connected to the at least one heating element. A control device is connected to the at least one heating element and the at least one temperature sensor. At least one sensor is connected to the control device and configured to detect at least one identifying feature of the different shaping tools received in the preheating station.

BRIEF DESCRIPTION OF THE DRAWINGS

The present invention will be described in even greater detail below based on the exemplary figures. The invention is not limited to the exemplary embodiments. All features described and/or illustrated herein can be used alone or combined in different combinations in embodiments of the invention. The features and advantages of various embodiments of the present invention will become apparent by reading the following detailed description with reference to the attached drawings which illustrate the following.

DETAILED DESCRIPTION

Figure 1:
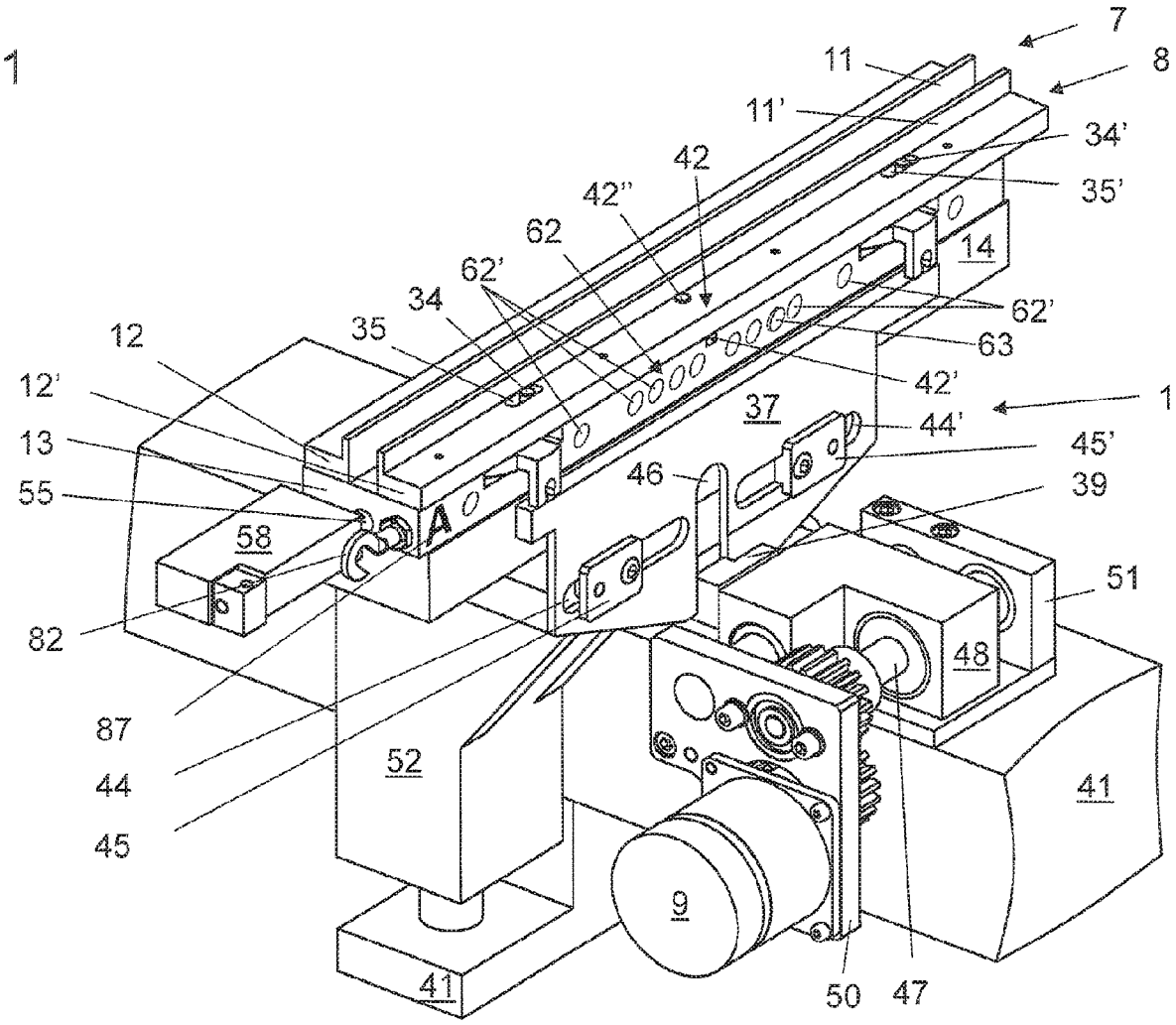
FIG. 1 is a spatial partial view of a device according to an embodiment of the invention for shaping a folding region of a lying outstretched book cover, the folding region being adjacent on either side of a spine region, showing a first shaping tool according to an embodiment of the invention that is equipped with an identification element and is intended for book covers having straight spines, an actuator by way of example and its connecting elements to the shaping tool.

Devices are therefore known from prior art which heat up the shaping tool that has already been installed in a device for shaping book covers. In the case of these devices, a certain length of time is needed after changing over the shaping tool in order to heat up the newly installed shaping tool before the next book cover can be shaped. This, however, has been found by the inventor as having a negative effect on the capacity of the device.

In order to overcome this disadvantage, a preheating station by the applicant has a heating element and a temperature sensor connected to the heating element, which preheating station is capable of receiving and preheating a single shaping tool suitable for an ensuing production order. After installing this preheated shaping tool in the device for shaping book covers, the device can advantageously immediately begin shaping the first book cover associated with the ensuing production order.

In this case, however, it is not possible either to check whether a shaping tool is located in the preheating station at all, or to check which of the shaping tools it is, the tools being different depending on the format of the book cover to be shaped. In the case of frequent changes in orders for producing books and therefore also book covers having straight spines or round spines and of varying book thicknesses, it has also been recognized by the inventor that a preheating station that is only suitable for preheating one single shaping tool can likewise become a limiting element for the capacity of the device for shaping book covers or even for the entire book production line.

In an embodiment, the invention provides a preheating station which is suitable for receiving and preheating more than one shaping tool for shaping book covers, and for reliably identifying the shaping tool required in each case in the preheating station even in the event of frequent order changes. Shaping tools which are suitable for being used in such a preheating station should also be provided. Finally, a suitable device for shaping outstretched book covers that has such a preheating station and a plurality of different shaping tools should be provided.

The preheating station according to an embodiment of the invention comprises a control device that is connected to the at least one heating element and the at least one temperature sensor, or is connected to such a control device. Moreover, the preheating station has a plurality of receiving spaces for different shaping tools for shaping book covers lying outstretched. Finally, the preheating station has at least one sensor connected to the control device for detecting at least one identifying feature of the shaping tools received in the preheating station.

Such a preheating station can receive and preheat a plurality of shaping tools and at most a number of shaping tools that corresponds to the number of receiving spaces. Owing to the arrangement of at least one sensor for detecting at least one identifying feature of the shaping tools received in the preheating station and the connection of said sensor to the control device, a shaping tool required for the ensuing order in each case can be reliably identified. Afterwards, this shaping tool is ready for use in a device for shaping the folding region of a lying outstretched book cover with a straight spine, the folding region being adjacent on either side of a spine region, or for shaping a spine region and the folding region. This allows an error-free assignment of shaping tools to the works order in each case and ultimately likewise an increase in capacity of the preheating station and therefore also of the entire book production line.

According to an embodiment of the preheating station according to the invention, the at least one sensor is arranged on the preheating station or aligned therewith. Structural design freedom is advantageously created by these alternative options for arranging the at least one sensor, which freedom can be used according to the specific installation situation of the preheating station.

According to a further embodiment of the preheating station, a plurality of sensors is arranged and the number of sensors corresponds to the number of receiving spaces. In this manner, one sensor can be assigned to each receiving space such that each shaping tool located in the preheating station can be identified individually.

According to a further embodiment, the preheating station is rectangular having two long sides and two end faces, the at least one sensor being arranged on a first long side and being designed as an optical sensor, and a reflector being arranged on a second long side opposite the at least one sensor.

A cost-effective solution that is not prone to faults can be achieved by such a design of the preheating station and a corresponding arrangement and design of the at least one sensor and the reflector.

According to a further embodiment of the preheating station, each receiving space is designed identically. As a result, each of the shaping tools, which are different per se but have an identical tool beam, can advantageously be positioned in any desired receiving space. The preheating station can therefore be equipped with the various shaping tools relatively quickly and in a simple manner.

According to an alternative embodiment, each receiving space is designed differently for receiving a specific shaping tool. It is therefore possible to design the heat output and/or the number of heating elements/temperature sensors individually according to the shaping tool in each case. In this way, each shaping tool can be assigned its own coded receiving space, the temperature of which can be set depending on the book cover to be processed. The temperature settings for the different materials are stored in the control device and can be assigned to coded receiving spaces on the basis of existing order data of the ensuing orders. As a result, the preheating station having the shaping tools located therein can react even faster to a forthcoming request in connection with a format change of the book covers to be shaped, which can further increase the capacity of the preheating station and therefore ultimately also the entire book production line.

According to a further embodiment, for this purpose, each receiving space has at least one first connecting element, which is designed differently and/or positioned differently for receiving one specific shaping tool of the different shaping tools. Which shaping tool is placed on which receiving space of the preheating station can therefore be defined in an advantageous manner using one single connecting element. Thus, each shaping tool only fits on one specific receiving space. Therefore, in the event of an order change, the receiving space on which the shaping tool needed for the following production order is located can be identified in advance. Therefore, each receiving space can also be heated up individually according to its relevant shaping tool and according to the forthcoming production orders. As long as a receiving space is empty, it can advantageously be heated at a lower temperature. Shaping tools which are only used very rarely in accordance with their thickness range can also be kept available at a lower temperature and only preheated to the correct temperature shortly before their use.

According to a further embodiment, each receiving space is provided with at least one first marking for one specific shaping tool of the different shaping tools, the markings of all receiving spaces differing from one another. In this alternative embodiment, the correct receiving space for placing each individual shaping tool is marked in each case. If the shaping tools are accordingly positioned on the correct receiving space, which shaping tool is placed on which receiving space of the preheating station is likewise defined.

According to an embodiment of the invention, a shaping tool has at least one identifying feature for detecting the shaping tool in a preheating station described above. A shaping tool is thus provided which can be detected in a simple and cost-effective manner in such a preheating station.

In one embodiment, the shaping tool has a tool beam for being received in the preheating station and the identifying feature is arranged on or in the tool beam. This results in a defined position of the identifying feature and thus ensures reliable detection of the shaping tool.

In a further embodiment, the identifying feature is designed as a number of closable recesses in the tool beam. The tool beam can therefore advantageously in each case already be provided during its production with the identifying feature, designed as a number of recesses. As a result, a cost-effective and permanently usable identifying feature is used which can also be applied cost-effectively to the shaping tool.

According to a further embodiment, the shaping tool has at least one second connecting element, which is advantageously designed to only correspond to one of a plurality of different receiving spaces of the preheating station.

According to an alternative embodiment, the shaping tool has at least one second marking, which is assigned to just one of a plurality of different receiving spaces of the preheating station.

According to an embodiment of the invention, a device for shaping a folding region of a lying outstretched book cover, the folding region being adjacent on either side of a spine region or for shaping the spine region and the folding region, has a preheating station described above and a plurality of different shaping tools.

In such a device, the combined advantages of a device designed for a plurality of shaping tools and having at least one sensor connected to the control device for detecting at least one identifying feature of the shaping tools received in the preheating station, and a plurality of shaping tools that are each provided with a corresponding identifying feature, can be used optimally.

In one embodiment of this device, in order to identify the different shaping tools, said shaping tools each have a tool beam for being received in the device and in the preheating station. Moreover, the heating station is rectangular having two long sides and two end faces, a number of optical sensors being arranged on a first long side of the preheating station and a reflector being arranged on a second long side, opposite the optical sensors. Finally, the tool beams each have a number of closable recesses designed as identifying features, the number of the closable recesses being at least as great as the number of the shaping tools used in the device and the number of optical sensors.

The device can therefore be equipped with any desired number of preheating stations arranged next to or on top of one another in order to receive the required number of shaping tools. Moreover, using the at least one sensor that interacts with the preheating station it is possible not only to identify the shaping tools currently in the preheating station but, conversely, it is also possible to deduce which shaping tool is currently located in the device. As a result of this identification of all the shaping tools of the device, it is possible to monitor the use of the shaping tools in the device and to prevent incorrect settings.

FIG. 1 is a partial view of a device 1 according to the invention for shaping book covers 2 lying outstretched (FIG. 5), which are each subsequently combined with a book block, which has a straight spine, to produce a book. Such a book cover 2 essentially consists of two lateral book boards 3, 3' and a central part, referred to as a spine region 4, which receives the spine of the book block. On its inner face, the spine region 4 can be provided with a strengthening insert 5, consisting, for example, of cardboard or recycled paper. The book cover 2 has one folding region 6, 6' on either side of the spine region 4 which connects said spine region to the book boards 3, 3' and forms an opening hinge in the finished book.

As shown in FIG. 1, the device 1 is equipped with a first shaping tool 8, which is located in a working position 7 and moreover has been moved out of a lowered position into a raised position, and is coupled to an actuator 9 designed as a drive motor. Spindle or worm drives, for example, can, of course, also be used as the actuator.

Figure 2:
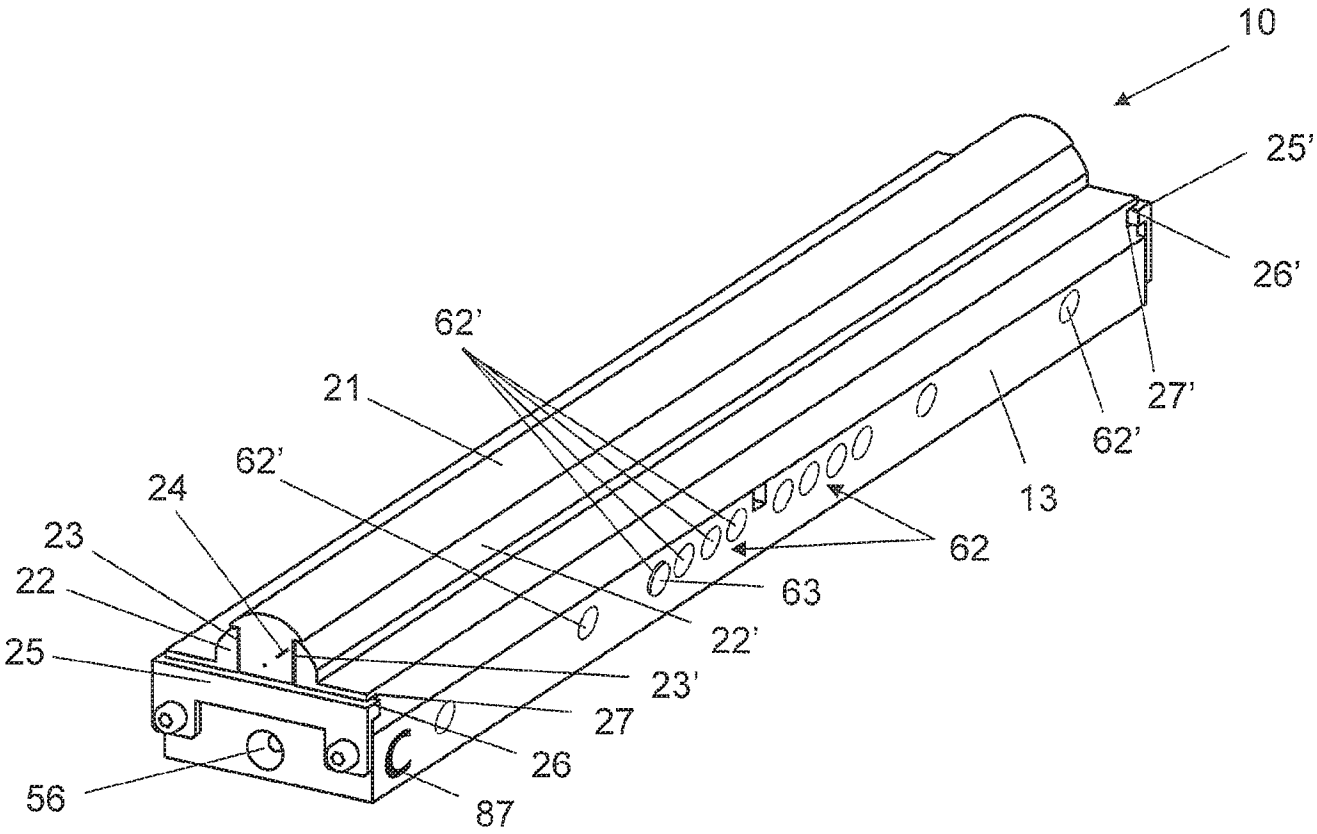
FIG. 2 is a spatial view of a second shaping tool according to an embodiment of the invention of the device according to an embodiment of the invention that is equipped with an identification element and is intended for shaping a spine region and a book cover lying outstretched on either side of a folding region adjacent to the spine region, the actuator and the connecting elements being omitted.

FIG. 2 shows a second shaping tool 10 of the device 1, which is then coupled to the same actuator 9 or alternatively also to another actuator if the book cover 2 lying outstretched in the device 1 is intended to be shaped into a book cover 2" having a round spine region 4" (FIG. 6) instead of into a book cover 2' having a straight spine region 4' (FIG.

4) according to a current production order. During shaping using the first or the second shaping tool 8, 10, each of the two folding regions 6, 6', and in the case of a book cover 2 provided for a round book block using the second shaping tool 10 additionally also its spine region 4, are shaped out of the stretched position such that the shaped book cover 2', 2" is subsequently suitable to be bound to a corresponding book block to form a book.

As likewise shown in FIG. 1, the first shaping tool 8 has two first shaping rails 11, 11' which are spaced apart from one another, stand vertically and are aligned in parallel with the spine region 4 of the book cover 2 to be shaped. On their lower end, the shaping rails 11, 11' each have a base rail 12, 12', which base rails in turn rest on a common tool beam 13 in a laterally adjustable manner and are non-positively or positively connected to said tool beam. In this manner, the shaping rails 11, 11' can be mutually adjusted according to the required width of the spine region 4 of the book cover 2.

On their underside, the shaping rails 11, 11' are, for example, provided with permanent magnets, or with electromagnets, which can be switched on and off, which generate relatively high attraction forces on the upper face of the ferrous tool beam 13. These attraction forces provide for a close contact between the upper face of the tool beam 13 and the shaping rails 11, 11', such that good heat transfer into the shaping rails 11, 11' and therefore onto the book cover 2 to be shaped, is ensured.

Figure 3:
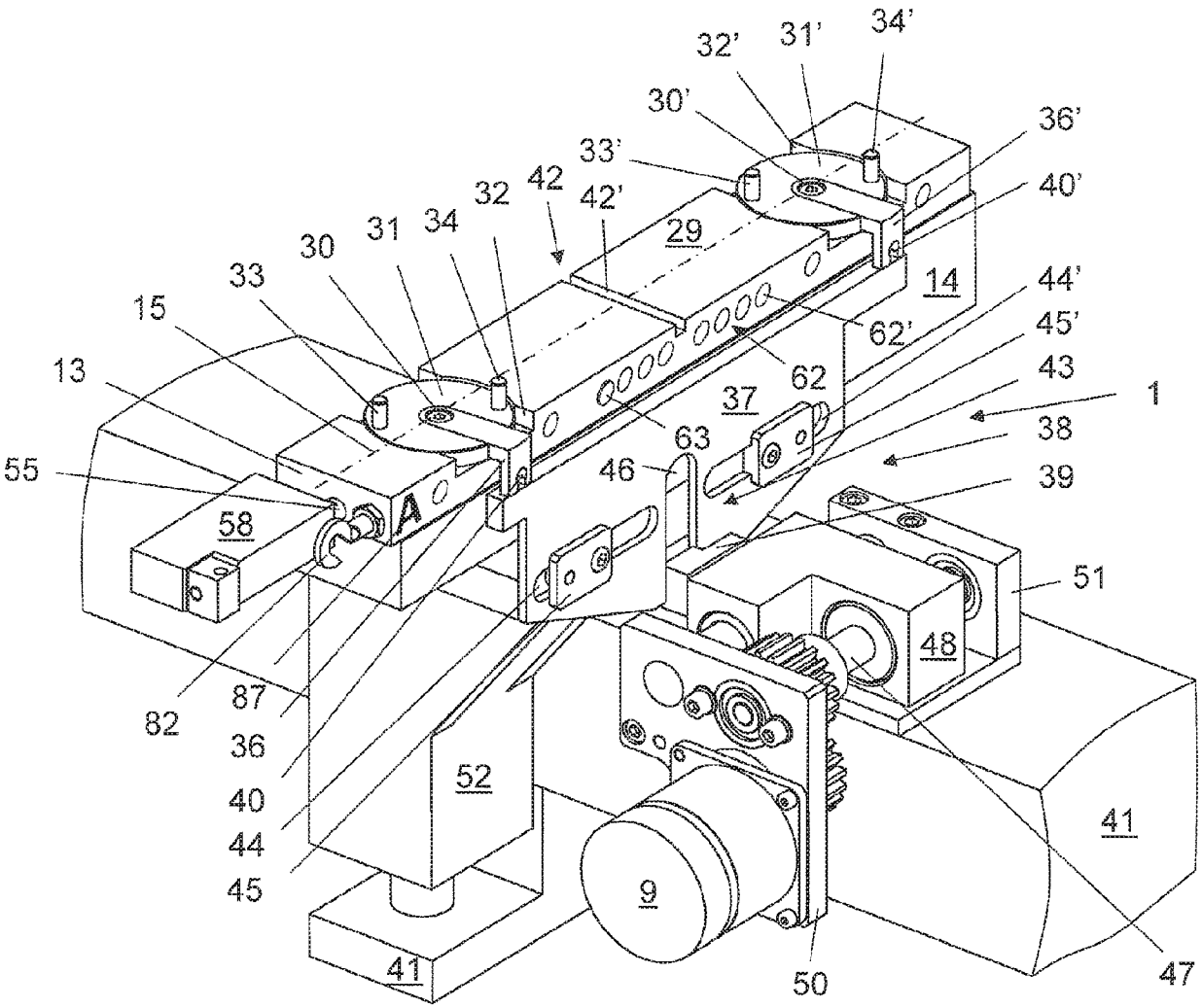
FIG. 3 is a view of the device from FIG. 1, with the shaping tool removed.

The tool beam 13 is approximately the length of the shaping rails 11, 11' and the base rails 12, 12' and is wider than the spacing between the shaping rails 11, 11' required for the largest book cover 2 to be shaped using the device 1. The tool beam 13, located, like the first shaping tool 8, in its working position 7, rests on a receiving element 14 of the device 1. The actuator 9 is arranged to the side of an imaginary, vertical plane through a longitudinal central axis 15 of the tool beam 13 (FIG. 3). The shaping rails 11, 11' are arranged symmetrically to the longitudinal central axis 15 of the tool beam 13 and are designed so as to be adjustable symmetrically to this longitudinal central axis 15.

Figure 7:
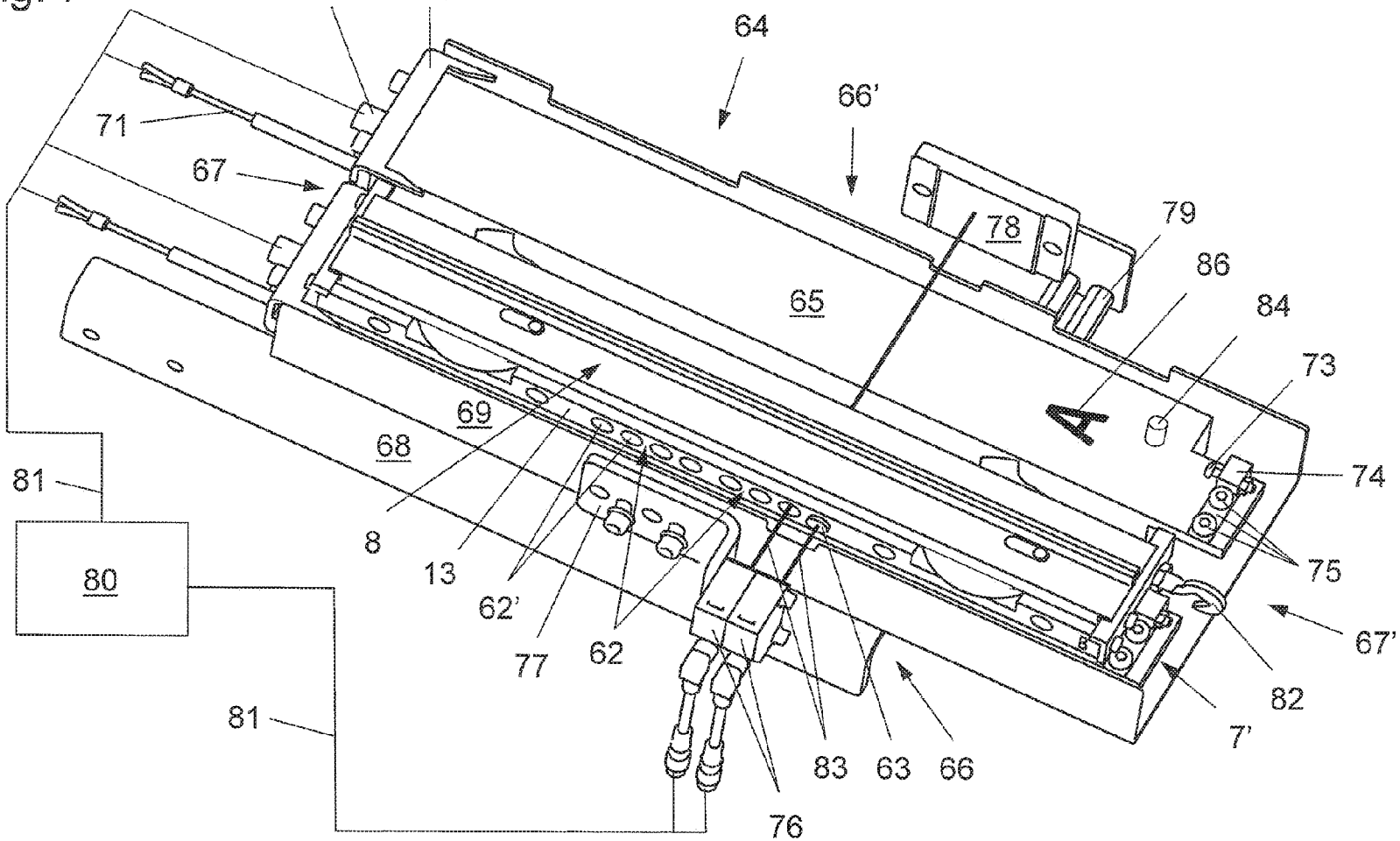
FIG. 7 is a lateral plan view of a preheating station according to an embodiment of the invention having two receiving spaces for shaping tools, the first receiving space being occupied by a shaping tool according to the invention for book covers having straight spines while the second receiving space is not occupied.
Figure 8:
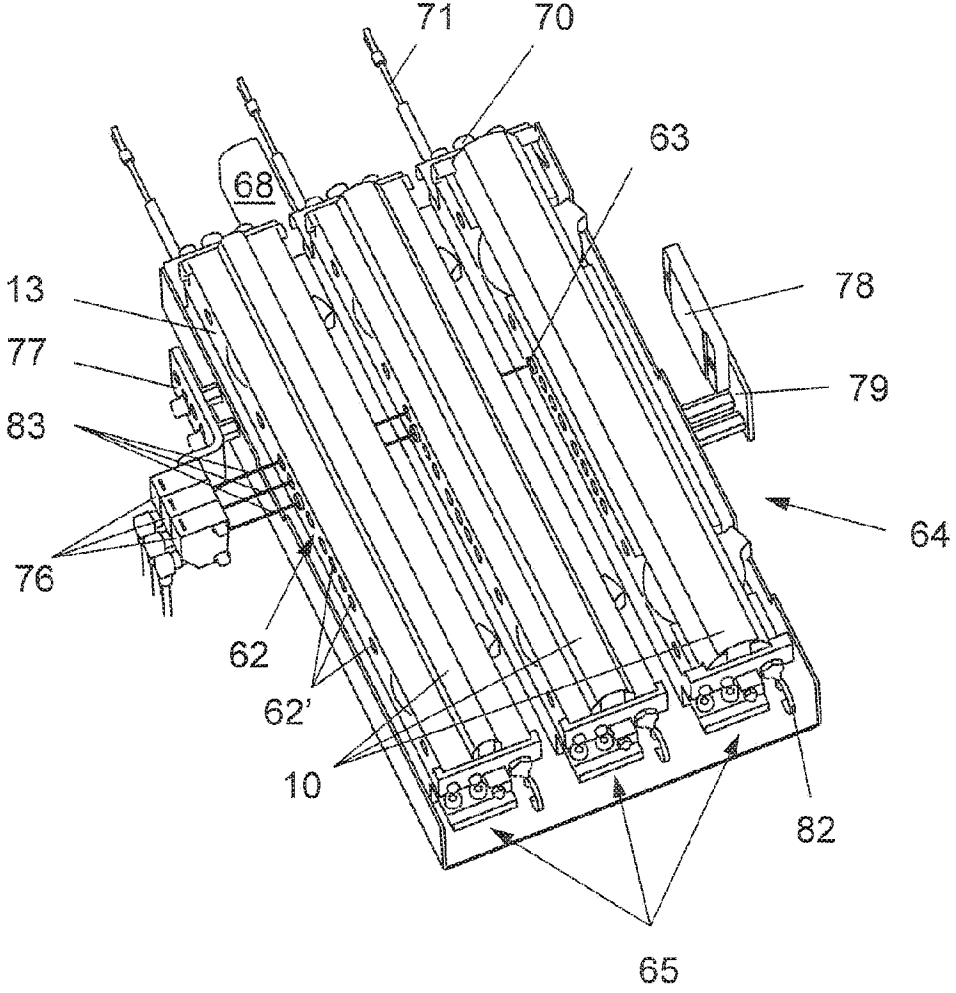
FIG. 8 is a plan view from the side at the front of a preheating station according to an embodiment of the invention having three receiving spaces, which are each occupied by a different shaping tool according to the invention for book covers having round spines, the shaping tools being suitable for shaping book covers for book blocks having different thicknesses.

An identifying feature 62 is arranged in the tool beam 13 and, in this embodiment, is designed as a number of recesses 62' that penetrate the tool beam 13, one of which can be closed by a closing element 63 designed, for example, as a stopper or lid. In principle, of course, any kind of mechanical components, but, for example, images which can be detected by cameras, numberings, bar codes, or even RFID chips, can also be used as the identifying feature 62. The identifying feature 62 can, of course, also be attached to the tool beam 13 instead of in the tool beam 13, but also in or on other components of the relevant shaping tool 8, 10. As described below, the identifying feature 62 is used for detecting the relevant shaping tool 8, 10 in a preheating station 64 according to the invention associated with the device 1 (FIG. 7, FIG. 8).

Figure 4:
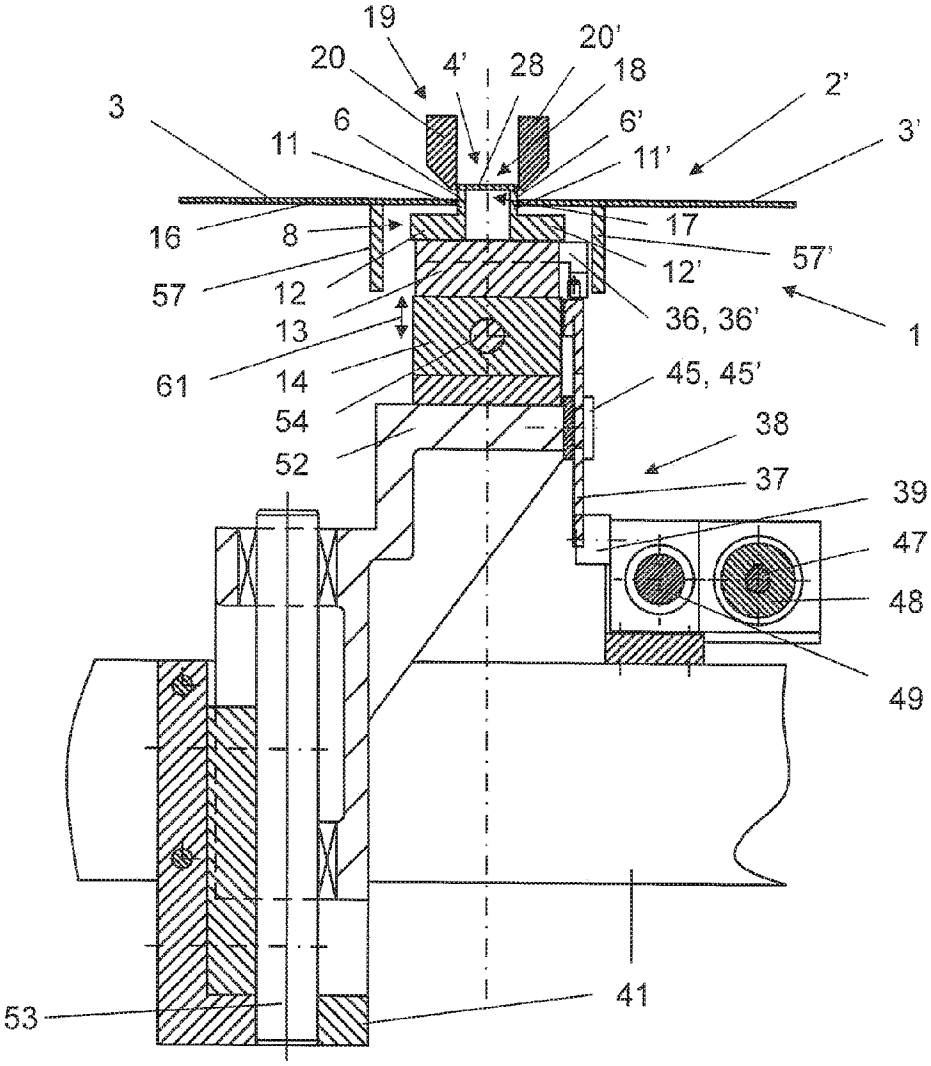
FIG. 4 is a cross section of the device shown in FIG. 1 showing a countertool and a shaped book cover.

In its lowered position, the first shaping tool 8, which at least almost extends beyond the height of a book cover 2, is initially located underneath and at a distance from a supporting flat surface 16 used to shape the book cover 2 and shown in FIG. 4, which extends transversely to the feed direction of the book block of a casing-in machine that is arranged downstream of the device 1, is used to bind the book block to the shaped book covers 2', 2".

In addition to the shaping tool 8, 10 located in the working position 7 in each case and oriented towards an inner face 17 of the spine region 4 of a book cover 2 to be shaped, the device 1 also has a countertool 19 which is arranged above the shaping tool 8, 10, interacts with said shaping tool and is oriented towards an outer face 18 of the spine region 4 of said book cover 2. The countertool 19 has two counter shaping rails 20, 20' which are spaced apart from one another, stand vertically and are oriented in parallel with the spine region 4 of the book cover 2 to be shaped (FIG. 4). These are likewise designed so as to be mutually adjustable according to the required width of the spine region 4 of the book cover 2.

According to FIG. 2, the second shaping tool 10 has a fixed, convex central shaping strip 21 oriented towards the countertool 19 (FIG. 5) and two convex outer shaping rails 22, 22', which are arranged to the sides of the central shaping strip 21, are laterally adjustable according to the rounding and the width of the spine region 4 of the book cover 2 to be shaped and are likewise oriented towards the countertool 19. The central shaping strip 21 is symmetrical and has, in a region facing the tool beam 13, one recess 23, 23' on either side for each receiving the outer shaping rails 22, 22' at least in part. Said outer shaping rails are designed so as to be adjustable symmetrically to a longitudinal central axis 24 of the central shaping strip 21.

Similarly to the shaping rails 11, 11' of the first shaping tool 8, the outer shaping rails 22, 22' of the second shaping tool 10 are also provided, on their underside, for example with permanent magnets, or with electromagnets, which can be switched on and off, which magnets generate relatively high attraction forces on the upper face of the ferrous tool beam 13. These attraction forces ensure a close contact between the upper side of the tool beam 13 and the outer shaping rails 22, 22', such that good heat transfer to said shaping rails 22, 22' and therefore also to the book cover 2 to be shaped is ensured. In addition to the described attraction forces, two end-face guides 25, 25' can absorb the processing forces during shaping of the relevant book cover 2. For this purpose, two protrusions 26, 26' of each of the two end-face guides 25, 25' penetrate into end-face grooves 27, 27' in the outer shaping rails 22, 22' and hold said rails in contact with the tool beam 13. The two end-face guides 25, 25' can be set such that they withstand a thermal expansion of several hundred degrees Celsius without impairment and do not counteract a slight movement of the outer shaping rails 22, 22'. Like the tool beam 13 of the first shaping tool 8, the tool beam 13 of the second shaping tool 10 also has an identifying feature 62, which is designed as a number of recesses 62' that penetrate the tool beam 13, one of which recesses can be closed by a closing element 63 designed, for example, as a stopper or lid.

Figure 6:
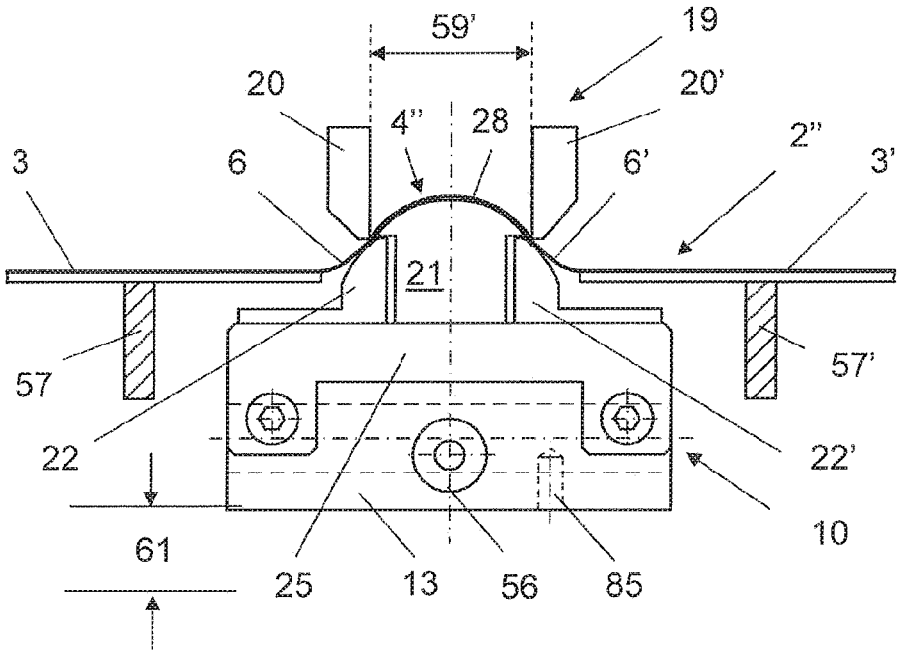
FIG. 6 is a view according to FIG. 5, but showing a book cover that has been rounded in the meantime.

In order to shape the folding regions 6, 6' of the book cover 2 provided on either side of the spine region 4, the relevant shaping tool 8, 10 together with the tool beam 13 is first raised against the countertool 19 arranged thereabove and its counter shaping rails 20, 20' and, in the process, a spine strip 28 of the book cover 2', 2" is formed using the shaping rails 11, 11' and using the central shaping strip 21 and the outer shaping rails 22, 22' (FIG. 4, FIG. 6). In the process, the curvatures of the central shaping strip 21 and the outer shaping rails 22, 22' of the second shaping tool 10 additionally ensure the rounding of the spine region 4" of the book cover 2" according to the rounding of the spine of an associated book block.

FIG. 3 is a partial view of the device 1 according to the invention, with the shaping tool 8, 10 removed. A smooth support surface 29 of the tool beam 13, which acts as a flat feed surface, is consequently visible, and has good sliding properties for the shaping tool 8, 10, which is located in its working position 7 in each case. As can be seen, the tool beam 13 is also used to receive rotating members, for example discs 31, 31', driven about vertical axes of rotation 30, 30', which are mounted in recesses 32, 32' in the tool beam 13 which are spaced apart from one another along the tool beam 13. On their side oriented towards the shaping tool 8, 10 located in the working position 7, the discs 31, 31' have catches 33, 34, 33', 34' opposite one another in relation to the relevant axis of rotation 30, 30'.

The discs 31, 31' are recessed into the tool beam 13 such that they do not touch the shaping tool 8, 10 located in the working position 7. In their side resting on the tool beam 13, the shaping tools 8, 10 each have recesses 35, 35' which are aligned in parallel with the axis of rotation 30, 30' of the discs 31, 31', and are at least partially penetrated by the catches 33, 34, 33', 34' designed, for example, as studs. Only the corresponding interaction between one of the catches 34, 34' and one of the recesses 35, 35' in the base rail 12', which is at the front in FIG. 1, of the first shaping tool 8 is shown. The rear base rail 12, of course, also has corresponding recesses 35, 35', which are, however, hidden here, in each of which a catch 33, 33' engages.

In order to achieve an optimally effective, lateral stroke of the shaping rails 11, 11' of the first shaping tool 8 connected to the base rails 12, 12' and of the outer shaping rails 22, 22' of the second shaping tool 10 mutually directed against one another, the catches 33, 34, 33', 34' of a disc 31, 31' are aligned in an initial position, for example, at an angle of approximately 45° to the longitudinal central axis 15 of the tool beam 13 so as to be diametrically opposite one another (FIG. 3). The rotary movements of the discs 31, 31' are achieved by a movement cam 36, 36' fastened on the circumference of each disc 31, 31' and projecting laterally over the tool beam 13, by means of a slider 37 of a sliding device 38, which is connected to an actuating cam 39. An even change of the distance between the shaping rails 11, 11' of the first shaping tool 8 or between the outer shaping rails 22, 22' of the second shaping tool 10 is thus ensured. The adjustment and setting of this distance can be achieved by means of a motor force or manual force. To increase accuracy, a control system connected to a variable motor can also be used.

The movement cams 36, 36' protruding on one side of the tool beam 13 are connected by means of joints 40, 40' or lateral guides to the slider 37, which is mounted on a frame 41 of the device 1 in an oscillating manner or so that it can be moved back and forth. As a result of a common rotation of the discs 31, 31', the catches 33, 34, 33', 34' each move inwards or outwards and, in the process, reduce or enlarge the distance between the shaping rails 11, 11' of the first shaping tool 8 or between the outer shaping rails 22, 22' of the second shaping tool 10.

So that the shaping rails 11, 11' of the first shaping tool 8 or the outer shaping rails 22, 22' of the second shaping tool 10 do not move relative to one another in their longitudinal direction when the discs 31, 31' rotate, a first guide arrangement 42 is provided between the tool beam 13 and the shaping tool 8, 10, which is located in the working position 7 in each case, transverse to its longitudinal extension, which, for example, has a groove 42' in the tool beam 13 extending transversely to the longitudinal extension of said components and a pin 42" (FIG. 1) or similar of the shaping tool 8, 10 engaging therein. In this manner, it is ensured that the shaping rails 11, 11' or the outer shaping rails 22, 22' are only adjustable transversely to the longitudinal extension of the relevant shaping tool 8, 10.

FIG. 4 is a cross section of the device 1 equipped with a first shaping tool 8 and a countertool 19, and an already shaped book cover 2' having a straight spine region 4' and having the two shaped folding regions 6, 6'. For reasons of clarity, the recesses 62' that penetrate the tool beam 13 and constitute the identifying feature 62 are not shown here. What is shown, however, is the arrangement of the shaping tool 8 likewise connected to the frame 41 and the sliding device 38 connected to the shaping tool 8 by means of the slider 37.

The slider 37, which is connected to the discs 31, 31' in a drivable manner and extends flat downwards has a second guide arrangement 43 (FIG. 3), which provides for its slidability parallel to the longitudinal extension of the tool beam 13. The second guide arrangement 43 has two slots 44, 44' which extend in this sliding direction and are spaced apart from one another, and one slide block 45, 45' fastened to the frame 41, assigned to each of the slots 44, 44' and entering said slots, on which the slider 37 is moved back and forth.

Between the slots 44, 44', a slit-like opening 46 reaching from below to above is provided for the actuating cams 39 designed as catches, which is indirectly connected to the actuator 9. The opening 46 allows a raising and lowering of the first shaping tool 8 connected to the frame 41.

As can be seen from FIGS. 1, 3 and 4, the actuator 9 shown is a gear motor, the driven shaft 47 of which is designed as a spindle. The driven shaft 47 passes through and engages with a spindle nut of a regulating element 48 guided on a rod 49 in the direction of the sliding movements of the slider 37, to which element the actuating cam 39 is fastened. In order to mount the driven shaft 47, a bearing shield 50 connected to the frame 41 and a bearing block 51 are provided. Instead of this, a rack and pinion gear can, of course, also be provided as the regulating device.

According to FIG. 4, the raising of the first shaping tool 8 takes place by means of a bracket 52, which is connected to the receiving element 14 of the tool beam 13 and interacts with a piston-cylinder unit, which is known, or with another lift drive, along a guide rod 53 fixed to the frame 41 of the device 1. As a result of the raising of the first shaping tool 8 (cf. the stroke 61 indicated by a double arrow), the spine region 4' of the book cover 2' is raised up by means of the two shaping rails 11, 11' spaced apart from one another between the opposing counter shaping rails 20, 20' of the countertool 19 forming a spine strip 28 and is shaped under the effect of heat, the book boards 3, 3' resting on inner support elements 57, 57' of a cover feed. In the process, the folding regions 6, 6' located on either side of the spine region 4' are shaped into opening hinges. For this purpose, the receiving element 14 arranged underneath the tool beam 13 is designed as a heating element and equipped with heating rods 54 from which the heat that keeps the shaping tool 8 at the operating temperature is transferred via the tool beam 13, the base rails 12, 12' and ultimately via the shaping rails 11, 11' to the spine region 4' to be shaped of the book cover 2'.

For an accurate positioning of the shaping tool 8, 10, a centering apparatus 58, for example, connected to the receiving element 14 is provided with a conical positioning pin 55 (FIG. 1, FIG. 3), which is engaged under spring pressure in a drilled hole 56 provided therefor (FIG. 2) on the end face of the tool beam 13.

With respect to the further configuration of the drive and of the connecting elements to the shaping tools of the device 1, reference is made to EP2325020 A1 mentioned at the outset, which is to be understood to be an integral component of the device 1 in this respect.

Figure 5:
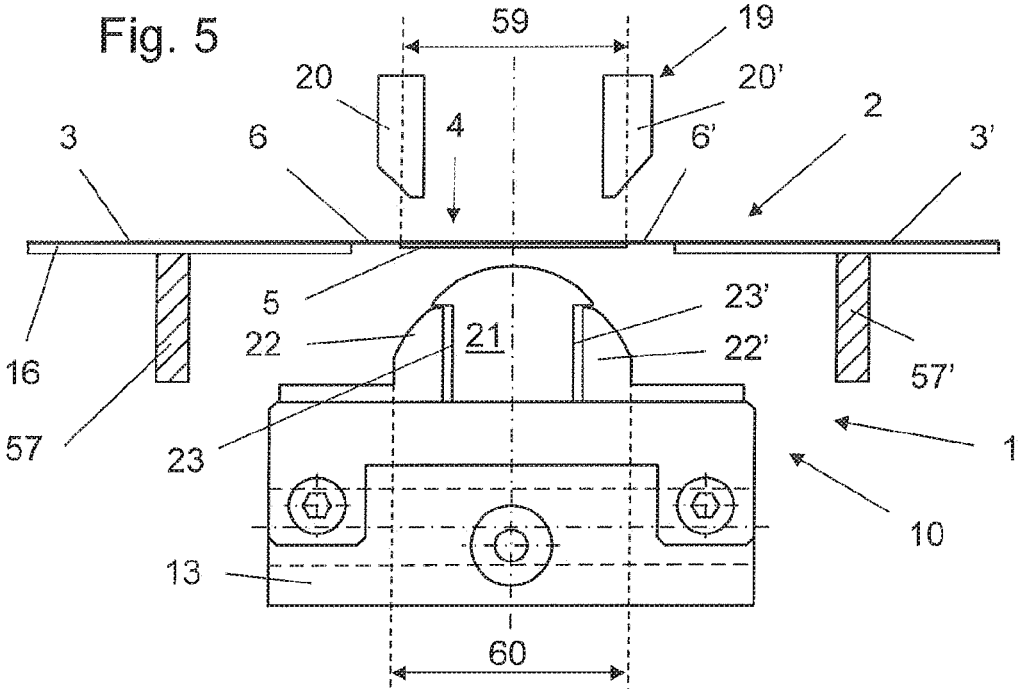
FIG. 5 is a schematic view of a detail of the device shown in FIG. 1, but showing the tool shown in FIG. 2 for book covers having round spines, the countertool and a book cover lying ready for shaping.

FIG. 5 is a detail of the device 1 with the second shaping tool 10 located in its working position 7, with the counter shaping rails 20, 20' of the counter tool 19 and a book cover 2 ready to be shaped lying on inner support elements 57, 57' of a cover feed. The second shaping tool 10 is still located in its lowered position, i.e. underneath the flat support surface 16, and is therefore at a distance from the book cover 2. In this position, the second shaping tool 10 is adjusted to a width 59 of the insert 5 of the spine region 4 of the book cover 2. For this purpose, the outer shaping rails 22, 22' of the second shaping tool 10 on the support surface 29 (FIG. 3) of the tool beam 13 are pushed further into the recesses 23, 23' on the central shaping strip 21 or further out of said recesses 23, 23' depending on the width 59 of the insert 5. The shape and equivalent radius of the second shaping tool 10 are determined by the thus adjusted external width 60 of the outer shaping rails 22, 22'.

FIG. 6 shows the second shaping tool 10 in its position in which it has in the meantime been raised upwards by one stroke 61 out of the position shown in FIG. 5. The stroke 61 depends on the thickness of the relevant book block and the associated book cover 2 and is calculated by a machine control system, and is transferred to the second shaping tool 10 as already described with regard to raising the first shaping tool 8. After shaping, the insert 5, and therefore the now rounded spine region 4" of the book cover 2" has shortened from its original width 59 to a projected width 59' thus forming a spine strip 28, inner edges of the counter shaping rails 20, 20' ending in outer edges of the insert 5. The projected width 59' of the insert 5 therefore corresponds to a thickness of the rounded and backed book block associated with this book cover 2".

FIG. 7 is a plan view from the side of a first embodiment of the preheating station 64 according to the invention having two receiving spaces 65 designed, for example, as heated beams, for one first shaping tool 8 each for shaping a book cover 2 for book covers 2' having a straight spine region 4'. Currently, only the first receiving space 65 of said preheating station 64 is occupied by a shaping tool 8, while the second receiving space 65 is empty.

The preheating station 64 is rectangular and has two long sides 66, 66' and two end faces 67, 67' and a beam 68 for connecting the preheating station 64 to the device 1 shown in FIG. 1 for shaping book covers 2 lying outstretched. Depending on the specific installation situation and the resultant spatial conditions, the preheating station 64 can be arranged in any desired place of the device 1, for example in the vicinity of a cover feed. Likewise, an arrangement of the preheating station 64 outside of the device 1 is also feasible, although the spacing should not be selected to be so great that the temperature of the preheated shaping tool 8 falls below the operating temperature required for shaping book covers 2 due to the time required for its transportation.

The beam 68 is used to fix the two receiving spaces 65 and also as a guard plate 69 surrounding said receiving spaces below and to the side to prevent the operating personnel from being burnt. In each case, a heating element 71, which is connected to a temperature sensor 70 fastened to a first end face 67 of the preheating station 64 and is designed, for example as a heating cartridge, is arranged in the region of the receiving spaces 65. Of course, a plurality of heating elements 71 can be used per receiving space 65 or more than one temperature sensor 70 can be used per heating element 71. The receiving spaces 65 each have a centering element 72 on their first end face 67 and, on a second end face 67', they each have a centering pin 73 having a fixture 74 and fastening elements 75 for connecting the centering pin 73 to the receiving space 65.

Two sensors 76 are arranged on a first long side 66 of the preheating station 64 so that the number of sensors 76 corresponds to the number of receiving spaces 65. The sensors 76 are fastened to the guard plate 69 by means of a common, first retaining element 77. A reflector 78, which interacts with the two sensors 76, is arranged on the opposite second long side 66' of the preheating station 64 and is fastened to the guard plate 69 by means of a second retaining element 79. The sensors 76 and the reflector 78 can, of course, also be fastened outside the preheating station 64 and be aligned with the preheating station 64. Moreover, the use of other sensors, which work without reflectors, is also possible. Finally, one single sensor can also be used for a plurality of receiving spaces 65 and the shaping tools 8, 10 received therein.

The preheating station 64 has a control device 80 or is connected to such a control device via connection lines 81 for transmitting signals and for the power supply. Such connection lines 81 are arranged here, for example, between the control device 80 and the sensors 76 as well as between the control device 80 and the heating elements 71 and the temperature sensors 70.

While one shaping tool 8 is located in a resting position 7' in the preheating station 64 (FIG. 7), the other shaping tool 8 associated with the empty receiving space 65 is arranged in the device 1 and is therefore located in the working position 7 shown in FIG. 1 and in FIG. 4.

In contrast, FIG. 8 shows a second embodiment of preheating station 64, which is constructed essentially similarly, but having three receiving spaces 65, each for a second shaping tool 10 for shaping book covers 2 having a round spine region 4" after shaping. The three receiving spaces 65 of this preheating station 64 are each occupied by one shaping tool 10, respectively, these shaping tools 10 each being able to shape a specific different thickness category of the spine region 4 of book covers 2.

First and second shaping tools 8, 10, which are also suitable for different thickness categories, can, of course, also be received simultaneously in a preheating station 64.

In order to install a shaping tool 8, 10 in the preheating station 64 and to remove it from the preheating station 64, the shaping tools 8, 10 each have a transport hook 82 on an end face of their tool beam 13, which hook can be turned by a special key, and with which the hot shaping tool 8, 10 can be placed onto the relevant receiving space 65 of the preheating station 64, or removed therefrom, by means of lifting gear. The mounting or removal of a shaping tool 8, 10 in or out of the device 1 for shaping book covers 2 lying outstretched can be carried out by the same lifting gear.

When installing a shaping tool 8, 10 in the preheating station 64, the centering element 72 together with the opposite centering pin 73, which receives the drilled hole 56 (FIG. 2) of the shaping tool 8, 10, ensures that the shaping tool 8, 10 is securely received.

As already described above, the tool beam 13 of the shaping tool 8, 10 has through recesses 62', which a beam 83 of the sensors 76 can pass through unimpeded. One of the recesses 62' of each shaping tool 8, 10 is provided with a closing element 63 such that the beam 83 of the sensor 76 oriented towards it can no longer pass through said recess 62'. With the aid of such an identifying feature 62 or by means of another suitable feature, the control device 80 can determine which shaping tool 8, 10 is installed in the preheating station 64. As soon as a shaping tool 8, 10 is removed, this is likewise detected, since the beam 83 of the relevant sensor 76 can pass through the area above the receiving space 65, which is then empty again, unimpeded and is thus reflected by the reflector 78, and it is therefore possible to check, in this simple manner, which shaping tools 8, 10 are located in the preheating station 64.

In this case, each receiving space 65 is designed identically to one another for receiving the different shaping tools 8, 10 carried by tool beams 13, which are likewise designed identically to one another. In this cost-effective solution, the sensors 76 can, however, only detect whether the correct or incorrect shaping tool 8, 10 has been removed after the removal of a shaping tool 8, 10 from the preheating station 64.

Alternatively, each receiving space 65 is designed differently for receiving a specific shaping tool 8, 10. For this purpose, each receiving space 65 has at least one connecting element 84 (FIG. 7), which is designed differently and/or positioned differently for receiving one specific shaping tool of the different shaping tools 8, 10. Accordingly, the shaping tool 8, 10 has at least one second connecting element 85 (FIG. 6), which is designed so as to correspond to only one of a plurality of different receiving spaces 65 of the preheating station 64. For this purpose, the first connecting element 84 is designed, for example, as a pin and the second connecting element 85 is designed, for example, as a recess in the tool beam 13 receiving the pin. Using two interacting connecting elements 84, 85 of this kind, the relevant shaping tool 8, 10 required for the ensuing works order for shaping book covers 2 can advantageously be reliably identified even before its removal from the preheating station 64.

Alternatively or, as shown in FIG. 7, in addition to the solution described above, each receiving space 65 can be provided with at least one first marking 86 for one specific shaping tool of the different shaping tools 8, 10, the first markings 86 of all the receiving spaces 65 differing from one another. Accordingly, the shaping tool 8, 10 has at least one second marking 87 (FIG. 1 to FIG. 3), which is assigned to just one receiving space 65 of the preheating station 64. In this cost-effective solution, when the shaping tools 8, 10 are resting according to the markings 86, 87, a prior and reliable identification of the relevant shaping tool 8, 10 required for the ensuing order can likewise be achieved. The markings 86, 87 can be formed as letters, as in the embodiments shown. Other kinds of marking are, of course, also possible, such as numbers or color markings.

The temperature of the preheated shaping tools 8, 10 can be between 20° C. and 300° C. depending on the materials used for covering the book covers 2. In the case of covering materials made from plastics material or cellophane, for example, relatively low temperatures are sufficient. In the case of very high cycle rates, the application time of the shaping tools 8, 10 on the book covers 2 is shorter and therefore production can be run at higher temperatures. If production is run at a slower speed, the application time of each shaping tool 8, 10 on the book cover 2 increases and the temperature of said shaping tool can be reduced. The temperature of the shaping tools 8, 10 being used in each case can be adjusted by the control device 80 depending on the order (production speed, covering material of the book cover, etc.) as desired.

While the invention has been illustrated and described in detail in the drawings and foregoing description, such illustration and description are to be considered illustrative or exemplary and not restrictive. It will be understood that changes and modifications may be made by those of ordinary skill within the scope of the following claims. In particular, the present invention covers further embodiments with any combination of features from different embodiments described above and below. Additionally, statements made herein characterizing the invention refer to an embodiment of the invention and not necessarily all embodiments.

The terms used in the claims should be construed to have the broadest reasonable interpretation consistent with the foregoing description. For example, the use of the article "a" or "the" in introducing an element should not be interpreted as being exclusive of a plurality of elements. Likewise, the recitation of "or" should be interpreted as being inclusive, such that the recitation of "A or B" is not exclusive of "A and B," unless it is clear from the context or the foregoing description that only one of A and B is intended. Further, the recitation of "at least one of A, B and C" should be interpreted as one or more of a group of elements consisting of A, B and C, and should not be interpreted as requiring at least one of each of the listed elements A, B and C, regardless of whether A, B and C are related as categories or otherwise. Moreover, the recitation of "A, B and/or C" or "at least one of A, B or C" should be interpreted as including any singular entity from the listed elements, e.g., A, any subset from the listed elements, e.g., A and B, or the entire list of elements A, B and C.

What is claimed is:

1. A preheating station for different shaping tools for shaping a folding region of a lying outstretched book cover, the folding region being adjacent on either side of a spine region, or for shaping the spine region and the folding region, the preheating station comprising:

a plurality of receiving spaces for the different shaping tools for shaping different book covers lying outstretched;

at least one heating element arranged in a region of each of the receiving spaces and at least one temperature sensor connected to the at least one heating element;

a control device connected to the at least one heating element and the at least one temperature sensor; and at least one sensor connected to the control device and configured to detect at least one identifying feature of the different shaping tools received in the preheating station.

2. The preheating station according to claim 1, wherein the at least one sensor is arranged on the preheating station or is aligned to the preheating station.

3. The preheating station according to claim 1, wherein a plurality of sensors are arranged and a number of the sensors corresponds to a number of receiving spaces.

4. The preheating station according to claim 1, wherein the preheating station is rectangular having first and second long sides and two end faces, the at least one sensor being arranged on the first long side and being designed as an optical sensor, a reflector being arranged on the second long side, opposite the at least one sensor.

5. The preheating station according to claim 1, wherein the receiving spaces are identical in design.

6. The preheating station according to claim 1, wherein each of the receiving spaces is designed differently to receive a specific one of the different shaping tools.

7. The preheating station according to claim 6, wherein each of the receiving spaces has at least one first connecting element, which is designed differently and/or positioned differently for receiving the specific shaping tool out of the different shaping tools.

8. The preheating station according to claim 6, wherein each of the receiving spaces is provided with at least one first marking for the specific shaping tool out of the different shaping tools, the markings of all the receiving spaces differing from one another.

9. A shaping tool for shaping a folding region of a lying outstretched book cover, the folding region being adjacent on either side of a spine region, or for shaping the spine region and the folding region, wherein the shaping tool has at least one identifying feature for detecting the shaping tool in the preheating station according to claim 1.

10. The shaping tool according to claim 9, wherein the shaping tool has a tool beam for receiving the shaping tool in the preheating station, and wherein the identifying feature is arranged on or in the tool beam.

11. The shaping tool according to claim 10, wherein the identifying feature is designed as a number of closable recesses in the tool beam.

12. The shaping tool according to claim 9, wherein the shaping tool has a least one second connecting element which is designed so as to only correspond to one of the receiving spaces of the preheating station.

13. The shaping tool according to claim 9, wherein the shaping tool has a least one second marking, which is assigned to just one of the receiving spaces of the preheating station.

14. A device for shaping a folding region of a lying outstretched book cover, the folding region being adjacent on either side of a spine region or for shaping the spine region and the folding region, the device comprising the preheating station according to claim 1 and a plurality of different shaping tools each with at least one identifying feature for detecting the respective shaping tool.

15. The device according to claim 14, wherein, in order to identify the different shaping tools:

the shaping tools each have a tool beam for receiving the shaping tools in the device and in the preheating station;

the preheating station is rectangular having first and second long sides and two end faces, a plurality of optical sensors being arranged on the first long side of the preheating station and a reflector being arranged on the second long side, opposite the optical sensors; and the tool beams each have a number of closable recesses designed as the identifying features, the number of closable recesses being at least as great as a number of shaping tools used in the device and a number of the optical sensors.

* * * * *